US010437164B2

(12) United States Patent
Hong et al.

(10) Patent No.: US 10,437,164 B2
(45) Date of Patent: Oct. 8, 2019

(54) TONER FOR DEVELOPING ELECTROSTATIC IMAGE

(71) Applicant: HP PRINTING KOREA CO., LTD., Suwon-si, Gyeonggi-do (KR)

(72) Inventors: Jin-mo Hong, Yongin-si (KR); Young-jae Kwon, Hwaseong-si (KR); Hwoing-woon Lee, Yongin-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 15/285,107

(22) Filed: Oct. 4, 2016

(65) Prior Publication Data

US 2017/0115585 A1 Apr. 27, 2017

(30) Foreign Application Priority Data

Oct. 21, 2015 (KR) ..... 10-2015-0146652

(51) Int. Cl.

| | |
|---|---|
| ***G03G 9/097*** | (2006.01) |
| ***G03G 9/087*** | (2006.01) |
| ***G03G 9/08*** | (2006.01) |
| ***G03G 9/09*** | (2006.01) |

(52) U.S. Cl.

CPC ..... *G03G 9/08755* (2013.01); *G03G 9/0804* (2013.01); *G03G 9/0819* (2013.01); *G03G 9/0825* (2013.01); *G03G 9/0827* (2013.01); *G03G 9/0918* (2013.01)

(58) Field of Classification Search

CPC .. G03G 9/0821; G03G 9/0825; G03G 9/0827; G03G 9/08755; G03G 9/08782; G03G 9/08795

See application file for complete search history.

(56) References Cited

U.S. PATENT DOCUMENTS

| | | | |
|---|---|---|---|
| 4,032,463 | A | 6/1977 | Kawanishi et al. |
| 4,162,226 | A | 7/1979 | Chatterji |

(Continued)

FOREIGN PATENT DOCUMENTS

| | | |
|---|---|---|
| JP | 2012-83739 | 4/2012 |
| JP | 2012-185277 | 9/2012 |
| JP | 2013-50578 | 3/2013 |
| JP | 2014-167597 | 9/2014 |

OTHER PUBLICATIONS

US 5,032,440 A, 07/1991, Koji et al. (withdrawn)

(Continued)

*Primary Examiner* — Peter L Vajda

(74) *Attorney, Agent, or Firm* — Staas & Halsey LLP

(57) ABSTRACT

A toner for developing an electrostatic image including a binder resin, a coloring agent, and a releasing agent are provided. A particle of the toner satisfies conditions of Equation (1) ($W_{(L)}/T_{(L)} \leq 0.1$ and Equation (2) $15 < N_{stain}$, where $N_{stain}$ refers to a number of stained releasing agent domains when the particle of the toner is stained with ruthenium tetraoxide ($RuO_4$) and a cross section of the particle of the toner is observed, $W_{(L)}$ refers to a longest length of lengths of the stained releasing agent domains, and $T_{(L)}$ refers to a longest length of the cross section of the particles of the toner.

7 Claims, 2 Drawing Sheets

(56) References Cited

U.S. PATENT DOCUMENTS 4,276,118 A 6/1981 Quick
4,904,562 A 2/1990 Yusa et al.
4,940,644 A 7/1990 Matsubara et al.
4,958,193 A 9/1990 Nojima et al.
4,990,418 A 2/1991 Mukoh et al.
5,017,416 A 5/1991 Imperial et al.
5,059,505 A 10/1991 Kashihara et al.
5,114,478 A 5/1992 Auslander et al.
5,229,188 A 7/1993 Takeuchi et al.
5,264,314 A 11/1993 Mahabadi et al.
5,352,553 A 10/1994 Takeuchi et al.
5,393,631 A 2/1995 Horikoshi et al.
5,432,035 A 7/1995 Katagiri et al.
5,460,915 A 10/1995 Nakanishi et al.
5,482,760 A 1/1996 Takeuchi
5,510,222 A 4/1996 Inaba et al.
5,514,510 A 5/1996 Hayakawa
5,547,804 A 8/1996 Nishizawa et al.
5,572,291 A 11/1996 Moriguchi et al.
5,582,902 A 12/1996 Kanbayashi et al.
5,582,950 A 12/1996 Katagiri et al.
5,595,849 A 1/1997 Niinae
5,607,808 A 3/1997 Nishizawa et al.
5,652,282 A 7/1997 Baker et al.
5,674,314 A 10/1997 Auslander et al.
5,681,381 A 10/1997 Auslander et al.
5,698,616 A 12/1997 Baker et al.
5,700,616 A 12/1997 Kasuya et al.
5,712,072 A 1/1998 Inaba et al.
5,741,617 A 4/1998 Inaba et al.
5,747,213 A 5/1998 Okado et al.
5,802,440 A 9/1998 Maeyama
5,862,447 A 1/1999 Matsumura
5,876,896 A 3/1999 Suda et al.
5,878,670 A 3/1999 Yamaguchi
5,981,129 A 11/1999 Akazawa et al.
6,044,243 A 3/2000 Hara
6,071,664 A 6/2000 Tavernier et al.
6,117,608 A 9/2000 Aoyagi et al.
6,168,896 B1 1/2001 Matsuoka et al.
6,200,719 B1 3/2001 Kuroda
6,233,424 B1 5/2001 Mohri et al.
6,238,835 B1 5/2001 Tavernier et al.
6,255,363 B1 7/2001 Baker et al.
6,287,742 B1 9/2001 Yoon
6,355,392 B1 3/2002 Yoon
6,410,200 B1 6/2002 William et al.
6,420,469 B1 7/2002 Suda
6,426,123 B1 7/2002 Aoyagi et al.
6,432,590 B1 8/2002 Ueda et al.
6,432,605 B1 8/2002 Yoon
6,461,782 B1 8/2002 Sasada et al.
6,566,026 B2 5/2003 Watanabe et al.
6,589,700 B2 7/2003 Tsutsumi et al.
6,617,091 B2 9/2003 Nishimori et al.
6,846,603 B2 1/2005 Fujii et al.
6,924,073 B2 8/2005 Higuchi et al.
6,929,835 B2 8/2005 Nakayama
7,001,701 B2 2/2006 Fujii et al.
7,008,745 B2 3/2006 Qian et al.
7,014,973 B2 3/2006 Qian et al.
7,129,013 B2 10/2006 Higuchi et al.
7,135,264 B2 11/2006 Qian et al.
7,244,540 B2 7/2007 Zhu et al.
7,252,920 B2 8/2007 Kurokawa et al.
7,267,919 B2 9/2007 Moribe et al.
7,303,848 B2 12/2007 Hill et al.
7,306,886 B2 12/2007 Herman et al.
7,306,888 B2 12/2007 Baker et al.
7,318,987 B2 1/2008 Simpson et al.
7,318,988 B2 1/2008 Zhu et al.
7,320,853 B2 1/2008 Chou et al.
7,374,854 B2 5/2008 Ninomiya et al.
7,396,628 B2 7/2008 Ninomiya et al.
7,405,027 B2 7/2008 Chou et al.
7,437,111 B2 10/2008 Yamada et al.
7,455,944 B2 11/2008 Maehata et al.
7,507,514 B2 3/2009 Tanma et al.
7,510,814 B2 3/2009 Liu et al.
7,531,276 B2 5/2009 Ishiyama et al.
7,642,030 B2 1/2010 Nomiya et al.
7,662,536 B2 2/2010 Matsumura et al.
7,702,271 B2 4/2010 Yamada et al.
7,906,264 B2 3/2011 Takahashi et al.
7,937,025 B2 5/2011 Nohsho et al.
8,133,649 B2 3/2012 McDougall et al.
8,137,888 B2 3/2012 Yang
8,293,444 B2 10/2012 Pawlak et al.
8,309,292 B2 11/2012 Sasaki et al.
8,431,307 B2 * 4/2013 Kim ..... G03G 9/0819 430/109.1
8,455,168 B2 6/2013 Kiyono et al.
8,501,379 B2 8/2013 Sugimoto et al.
8,518,623 B2 8/2013 Kamikura et al.
8,580,285 B2 11/2013 Falk et al.
8,592,116 B2 11/2013 Pang et al.
8,642,239 B2 2/2014 Hong et al.
8,722,296 B2 5/2014 Mizutani et al.
8,778,588 B2 7/2014 Kusahara et al.
8,795,933 B2 8/2014 Doi et al.
8,808,956 B2 8/2014 Chonan et al.
8,822,121 B2 9/2014 Pang et al.
8,846,284 B2 9/2014 Kinumatsu et al.
8,871,415 B2 10/2014 Nagasawa et al.
8,883,387 B2 11/2014 Miyata et al.
8,916,323 B2 12/2014 Sugama et al.
8,956,798 B2 2/2015 Sata et al.
8,974,991 B2 3/2015 Kawahara et al.
9,005,855 B2 4/2015 Iwadate et al.
9,034,543 B2 5/2015 Iwadate et al.
9,056,955 B2 6/2015 Mizumori et al.
9,081,316 B2 7/2015 Hong et al.
2001/0044064 A1 11/2001 Yoon
2002/0006571 A1 1/2002 Suda et al.
2004/0071943 A1 4/2004 Kamiyama et al.
2006/0078817 A1 4/2006 Hsieh et al.
2006/0251977 A1 11/2006 Kim
2007/0009818 A1 1/2007 Yanagawa et al.
2007/0189824 A1 8/2007 Furuya et al.
2008/0003512 A1 1/2008 Kobayashi et al.
2008/0096120 A1 4/2008 Yamaguchi et al.
2009/0233776 A1 9/2009 Mizumoto et al.
2010/0297041 A1 11/2010 Smith et al.
2010/0330486 A1 12/2010 Zhou et al.
2011/0104605 A1 * 5/2011 Kim ..... G03G 9/0819 430/108.4
2011/0151368 A1 * 6/2011 Hong ..... G03G 9/0819 430/108.8
2013/0059246 A1 3/2013 Hong
2013/0143154 A1 6/2013 Takashi et al.
2014/0087300 A1 3/2014 Uno et al.
2014/0087302 A1 3/2014 Kim et al.
2014/0087304 A1 3/2014 Uno et al.
2014/0205939 A1 7/2014 Nukada et al.
2015/0037724 A1 2/2015 Mizobe
2015/0140488 A1 5/2015 Terasaki
2015/0153666 A1 6/2015 Isono et al.
2015/0153668 A1 6/2015 Tanaka et al.
2015/0153670 A1 6/2015 Shimano et al.
2016/0002396 A1 * 1/2016 Ida ..... C08G 63/183 528/308.6

OTHER PUBLICATIONS

A Method for Estimating Both the Solubility Parameter and Molar Volumes of Liquids in Polymer Engineering & Science, Robert F. Fedors, 14, (2), pp. 147-154 (1974).*

Excerpt(s) from D.W. Van Krevelen, "Properties of Polymers"; 3rd edn., p. 190-196, Elsevier (1990) (2 pages being submitted).

* cited by examiner

TONER FOR DEVELOPING ELECTROSTATIC IMAGE

CROSS-REFERENCE TO RELATED APPLICATIONS

This application claims the priority benefit of Korean Application No. 10-2015-0146652, filed Oct. 21, 2015, in the Korean Intellectual Property Office, the disclosure of which is incorporated herein by reference.

BACKGROUND

1. Field

Apparatuses and methods consistent with exemplary embodiments relate to a toner for developing an electrostatic image, and more particularly, to a toner for developing an electrostatic image, which can enhance all of a wide fusing latitude, a gloss, anti-cohesiveness, storage stability, and low-temperature fixing ability.

2. Description of the Related Art

Toners for developing an electrostatic image are used in printing devices based on electrophotographic and electrostatic image developing processes.

From among quality items of toners, a small particle size, narrow particle size distribution, wide color gamut, and low fixing temperature have become important. The small particle size, the narrow particle size distribution, and the wide color gamut are required to obtain a print image of high quality, and the low fixing temperature is required to reduce energy consumption required to print and carbon dioxide emissions. In addition, other quality items such as heat storage ability, anti-cohesiveness of toners, and charging stability have become important.

As a toner producing method, a pulverizing process is known. However, in the pulverizing process, excessive energy is consumed to produce a toner of a small particle size, and it is difficult to control morphology of a toner particle. In addition, a releasing agent or a pigment is exposed to the surface of a toner particle, and thus there is a problem that the anti-cohesiveness and storage ability of the toner easily deteriorate.

An emulsion and aggregation (EA) process is known as another method for producing toners. In the EA process, a toner particle is grown through aggregation of particles of various raw materials. Accordingly, the quality items such as the small particle size and the narrow particle size distribution can be easily achieved in the EA. In addition, it is relatively easy to control the morphology of the toner particle, high resolution can be obtained by enhancing dot/line reproducibility, and energy saving, enhanced transfer efficiency, and charging stability can be achieved by reduction in an amount of toner.

The EA process has been on the spotlight due to the above-described advantages. A toner which is produced in the EA process is called a "polymerized toner." In the related-art EA process, a styrene-acrylate copolymer is used as a binder resin. However, in various application fields of color toners, there is still a demand for enhancement of transparency and fixing temperature of the binder resin.

The related-art method suggests a toner particle which has a resin layer (shell) formed on the surface of a coloring particle (core particle) containing a resin and a coloring agent, in order to provide a polymerized toner which does not cause a change in image concentration, which is caused by a change in a charging property and a developing property, fogging, and a change of a color image even when an amount of coloring agent existing on the particle surface is small and the toner is provided to form an image for a long time under a high-humidity environment. This method can enhance charging uniformity between colors by suppressing surface exposure of the coloring agent.

However, when much wax which is a releasing agent is contained, for example, the heat storage ability and the anti-cohesiveness of toners may deteriorate due to plasticization which is caused by partial miscibility between a low molecular weight portion and a binder resin of the wax.

In addition, a method for reducing glass transition temperature (Tg) of the binder resin and capsulating the binder resin to have somewhat high Tg has been suggested to fix at low temperature. However, it is known that this method can achieve the aim of fixing at low temperature, but is not enough to achieve heat storage ability and a high gloss.

SUMMARY

Additional aspects and/or advantages will be set forth in part in the description which follows and, in part, will be apparent from the description, or may be learned by practice of the invention.

One or more exemplary embodiments may overcome the above disadvantages and other disadvantages not described above. However, it is understood that one or more exemplary embodiments are not required to overcome the disadvantages described above, and may not overcome any of the problems described above.

One or more exemplary embodiments provide a toner for developing an electrostatic image, which can enhance at least one (e.g., all) of a wide fusing latitude, a gloss, anti-cohesiveness, storage stability, and low-temperature fixing ability.

According to an aspect of an exemplary embodiment, a toner for developing an electrostatic image is provided, the toner including a binder resin, a coloring agent, and a releasing agent, wherein a particle of the toner satisfies conditions of Equations (1) and (2):

$$(W_{(L)}/T_{(L)} \leq 0.1 \quad (1)$$

$$15 < N_{stain} \quad (2)$$

where $N_{stain}$ refers to a number of stained releasing agent domains when the particle of the toner is stained with ruthenium tetraoxide ($RuO_4$) and a cross section of the particle of the toner is observed, and $W_{(L)}$ refers to a longest length of lengths of the stained releasing agent domains, and $T_{(L)}$ refers to a longest length of the cross section of the particles of the toner.

The binder resin and the releasing agent may satisfy Equation (3):

$$|SP_{(Binder)} - SP_{(Wax)}| > 5 \quad (3)$$

where $SP_{(Binder)}$ is a solubility parameter $[(J/cm^3)^{0.5}]$ of the binder resin, and $SP_{(Wax)}$ is a solubility parameter $[(J/cm^3)^{0.5}]$ of the releasing agent.

The binder resin may include a low molecular weight binder resin having weight-average molecular weight less than 500 g/mol to be less than or equal to 3.5 wt % of the whole binder resin.

An average of circularity of the toner may be 0.940 to 0.980.

An average particle size of the toner may be 3 to 9.5 μm.

A volume average particle size distribution index (GSDv) of the toner may be less than or equal to 1.25 and a number average particle size distribution index (GSDp) of the toner may be less than or equal to 1.30.

From among the particles of the toner, a fine particle having a particle size less than or equal to 3 μm may be less than 3 wt %, and a coarse particle having a particle size greater than or equal to 16 μm may be less than 0.5 wt %.

According to an aspect of another exemplary embodiment, there is provided a consumable unit of an image forming apparatus including the above-described toner.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
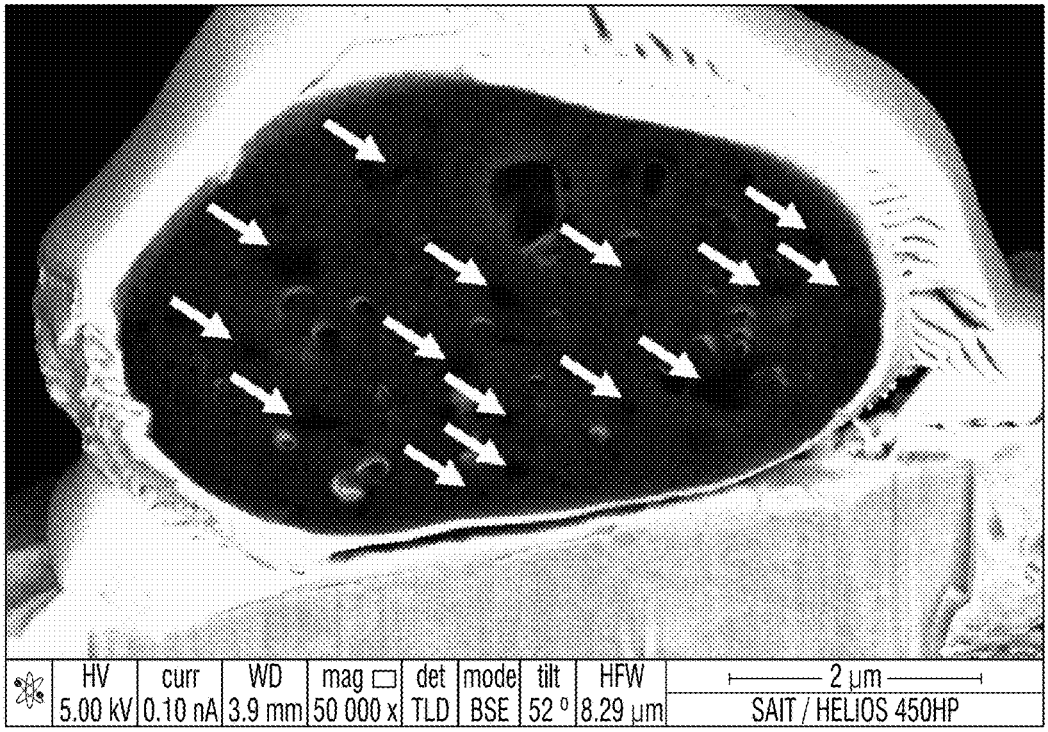
FIG. 1 is a view showing a cross sectional scanning electron microscopy (SEM) image of a toner according to an exemplary embodiment.

Reference will now be made in detail to the embodiments, examples of which are illustrated in the accompanying drawings, wherein like reference numerals refer to the like elements throughout. The embodiments are described below to explain the present invention by referring to the figures.

Certain exemplary embodiments are described in higher detail below with reference to the accompanying drawings.

In the following description, like drawing reference numerals are used for the like elements, even in different drawings. The matters defined in the description, such as detailed construction and elements, are provided to assist in a comprehensive understanding of exemplary embodiments. However, exemplary embodiments can be practiced without those specifically defined matters. Also, well-known functions or constructions are not described in detail since they would obscure the application with unnecessary detail.

Terms such as 'first' and 'second' may be used to describe various components, but they should not limit the various components. Those terms are only used for the purpose of differentiating a component from other components. For example, a first component may be referred to as a second component, and a second component may be referred to as a first component and so forth without departing from the spirit and scope of the present disclosure. Furthermore, 'and/or' may include any one of or a combination of the components mentioned.

Furthermore, a singular form may include a plural from as long as it is not specifically mentioned in a sentence. Furthermore, "include/comprise" or "including/comprising" used in the specification represents that one or more components, steps, operations, and elements exist or are added.

Hereinafter, a toner for developing an electrostatic image according to various exemplary embodiments will be described in detail.

The toner for developing the electrostatic image according to exemplary embodiments includes a binder resin, a coloring agent, and a releasing agent.

The binder resin plays a role for fixing the releasing agent and the coloring agent.

The binder resin may include a polyester resin alone or may include a mixture (hybrid type) of a polyester resin and a polymer prepared by polymerizing at least one polymerizable monomer The polyester resin is a polymer that is obtained by a condensation reaction of poly fatty acid and polyhydric alcohol, and can be used without any limitation as long as the polyester resin is suitable for providing a toner for developing a high-quality and high-gloss electrostatic image, which can realize low-temperature fixing and has good heat storage ability and good color reproducibility. For example, the polyester resin may have a weight-average molecular weight of about $1.0\times10^4$ to $4.0\times10^4$ g/mol, and a glass transition temperature ($T_g$) of about 50 to 70° C. Accordingly, the binder resin of the toner may include two or more kinds of polyester resins having different weight-average molecular weights and glass transition temperatures.

Examples of the poly fatty acid are aliphatic dicarboxylic acid and aromatic dicarboxylic acid, and they may be used alone or in combination.

For example, the aliphatic dicarboxylic acid may be, but not limited to, oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1-11-undecane dicarboxylic acid, 1-12-dodecane dicarboxylic acid, 1,13-tridecane dicarboxylic acid, 1-14-tetradecane dicarboxylic acid, 1-16-hexadecane dicarboxylic acid, 1,18-octadecane dicarboxylic acid, or the like, or lower alkyl ester thereof or acid anhydride.

For example, the aromatic dicarboxylic acid may be terephthalic acid, isophthalic acid, ortophthalic acid, t-butyl isophthalic acid, 2,6-naphthalene dicarboxylic acid, 4,4'-biphenyl dicarboxylic acid, or the like.

For example, the polyhydric alcohol may be, but not limited to, ethylenegylcol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, or the like.

A catalyst which may be used in producing the polyester resin may include: an alkali metal compound such as sodium, lithium, or the like; an alkaline earth metal compound such as magnesium, calcium, or the like; a metal compound such as zinc, manganese, stibium, titanium, tin, zirconium, germanium, or the like; a phosphorous acid compound; a phosphate compound; and an amine compound.

The releasing agent may play a role for increasing low-temperature fixing ability, good final image durability, and abrasion resistance of toners. The releasing agent may be natural wax or synthetic wax. The releasing agent is not limited to these and may be selected from the group consisting of polyethylene-based wax, polypropylene-based wax, silicone wax, paraffin-based wax, ester-based wax, carnauba wax, and metallocene wax.

The releasing agent may be ester-based wax including an ester group. Examples of the releasing agent include (1) a mixture of ester-based wax and non-ester-based wax; or (2) ester group-containing wax which contains an ester group in non-ester-based wax. The ester group has a high affinity with the latex component of the toner and thus wax of the toner particles can uniformly exist. Therefore, the ester group may effectively promote the action of the wax. The non-ester-based wax component may suppress excessive plasticization, which may be caused when only the ester-based wax is provided, by the releasing action with the latex. As a result, the mixture of the ester-based wax and the non-ester-based wax can maintain the good developing ability of the toner for a long time.

For example, the ester-based wax may be fatty acid of carbon numbers 15-30 and ester of mono- to penta-hydric alcohol, such as behenic acid behenyl, stearic acid stearyl, stearic acid ester of pentaerythritol, montanic acid glyceride, or the like. The alcohol component constituting the ester may be alcohol of carbon numbers 10-30 or polyhydric alcohol of carbon numbers 3-10.

The non-ester-based wax includes polyethylene-based wax, polypropylene-based wax, silicone wax, paraffin-based wax, or the like. Examples of the ester-based wax including the ester group may include a mixture of paraffin-based wax and ester-based wax; or paraffin-based wax containing an ester group. Specifically, examples of the ester-based wax may include product names P-212, P-280, P-318, P-319, P-419, and the like of CHUKYO YUSHI CO., LTD.

When the releasing agent is a mixture of paraffin-based wax and ester-based wax, the content of the ester-based wax may be about 1-35 wt %, about 5-30 wt %, or about 7-30 wt % with reference to the total weight of the mixture of the paraffin-based wax and the ester-based wax. When the content of the ester-based wax is 1 wt % or more, compatibility with latex can be sufficiently maintained, and, when the content of the ester-based wax is 35 wt % or less, the plasticity of toner is appropriate and thus can maintain the developing ability for a long time.

Melting temperature of the releasing agent may be 60 to 100° C. in one example or 70-90° C. in another example. The component of the releasing agent is physically in close contact with toner particles, but does not perform covalent bonding with the toner particles.

For example, the content of the releasing agent may be about 1-20 parts by weight, about 2-16 parts by weight, or about 3-12 parts by weight for every 100 parts by weight of the toner. When the content of the releasing agent is 1 part by weight or more, low-temperature fixing ability is good and a sufficient fixing temperature range is guaranteed, and, when the content of the releasing agent is 20 parts by weight or less, storage ability and economic effects can be enhanced.

The coloring agent may be a black coloring agent, a cyan coloring agent, a magenta coloring agent, or a yellow coloring agent, for example.

The black coloring agent may be carbon block or aniline black.

The yellow coloring agent may be a condensation nitrogen compound, an isoindolinone compound, an anthraquinone compound, an azo metal complex dye, or an aryl imide compound. Specifically, the yellow coloring agent may include C.I. pigment yellow 12, 13, 14, 17, 62, 74, 83, 93, 94, 95, 109, 110, 111, 128, 129, 147, 168, 180, or the like.

The magenta coloring agent may be a condensation nitrogen compound, an anthraquine compound, a quinacridone compound, a base dye rate compounds, a naphthol compound, a benzo imidazole compound, a thioindigo compound, or a parylene compound. Specifically, the magenta coloring agent includes C.I. pigment red 2, 3, 5, 6, 7, 23, 48:2, 48:3, 48:4, 57:1, 81:1, 122, 144, 146, 166, 169, 177, 184, 185, 202, 206, 220, 221, or 254.

The cyan coloring agent may use a copper phthalocyanine compound and derivatives thereof, or an anthraquinone compound, or the like. Specifically, the cyan coloring agent includes C.I. pigment blue 1, 7, 15, 15:1, 15:2, 15:3, 15:4, 60, 62, or 66.

These coloring agents may be used alone or in combination, and may be selected in consideration of color, chroma, brightness, weather resistance, dispersing ability of toner, or the like.

It may be sufficient if the content of the coloring agent can stain the toner. For example, the content of the coloring agent may be about 0.5-15 parts by weight, about 1-12 parts by weight, or about 2-10 parts by weight for every 100 parts by weight of toner. When the content of the coloring agent is 0.5 parts by weight or more for every 100 parts by weight of the toner, a staining effect can be sufficiently realized. When the content of the coloring agent is 15 parts by weight or less, sufficient amount of triboelectric charges can be provided without increasing the production cost of the toner.

The particles of the toner may satisfy the conditions of equations (1) and (2):

$$(W_{(L)}/T_{(L)} \leq 0.1 \quad (1)$$

$$15 < N_{stain} \quad (2)$$

Herein, $N_{stain}$ refers to the number of stained releasing agent domains when the cross section of the particle of the toner is stained with rutheniumtetroxide: $RuO_4$), $W_{(L)}$ refers to the longest length of the lengths of the stained releasing agent domains, and $T_{(L)}$ refers to the longest length of the toner particle cross section. That is, a ratio of the longest length of the toner particle cross section to the longest length of the lengths of the stained releasing agent domains may be 0.1 or less.

When equations (1) and (2) are not satisfied, the number of releasing agent domains in the inner structure of the toner is reduced and thus dispersity is reduced. In addition, an adhesion force between a fixing roller and a toner increases when the toner is fixed, that is, releasability indicating the ability of releasing the releasing agent to the outside of the toner is reduced, and thus temperature energy increases. To this end, a peeling force is reduced. Accordingly, minimum temperature at which hot offset occurs is reduced (an image defect occurs at high temperature), and thus fusing latitude is reduced. In addition, the surface roughness of a printed toner increases and thus a gloss, anti-cohesiveness, heat storage ability, and storage stability seriously deteriorate.

In addition, the binder resin and the releasing agent of the toner particles may satisfy equation (3):

$$SP_{(Binder)} - SP_{(Wax)}| > 5 \quad (3)$$

Herein, $SP_{(Binder)}$ is a solubility parameter $[(J/cm^3)^{0.5}]$ of the binder resin, and $SP_{(Wax)}$ is a solubility parameter $[(J/cm^3)^{0.5}]$ of the releasing agent.

In other words, the releasing agent is selected such that the solubility parameter (SP) value of the binder resin of the toner has a difference exceeding 5, compared with the solubility parameter (SP) value of the releasing agent. When the difference between the SP values is less than or equal to 5, miscibility between the binder resin and the releasing agent increases and thus the peeling force between the roller and the toner is reduced. As a result, the fusing latitude is reduced and thus the gloss and the anti-cohesiveness deteriorate.

In addition, the binder resin of the toner particles may include a low molecular weight binding resin having weight-average molecular weight less than 500 g/mol to be less than or equal to 3.5 wt % of the whole binder resin. This molecular weight is a value which is obtained by measuring molecular weight by gel permeation chromatography (GPC) of a tetrahydrofuran soluble component.

When the low molecular weight binding resin of the binder resin having the weight-average molecular weight less than 500 g/mol exceeds 3.5 wt %, the ratio of the low molecular weight increases and thus plasticization occurs. As a result, durability is reduced. This results in reduction in the fusing latitude and thus the gloss and the anti-cohesiveness deteriorate.

Hereinafter, a method for producing a toner for developing an electrostatic image based on an emulsion and aggregation (EA) process according to an exemplary embodiment is described.

Latex may be produced by a polyester resin that is produced by condensation polymerization. The latex may be produced by phase inversion emulsification by dispersing a polyester resin, an alkali compound, and a surfactant in water if necessary.

A polyester organic solution may be produced by dissolving the polyester resin in an organic solvent. As the organic solvent, a known organic solvent may be used, but typically, a ketone solvent such as acetone, methyl ethyl ketone, or the like; an aliphatic alcohol solvent such as methanol, ethanol, isopropanol, or the like; and a mixture thereof may be used. NaOH, KOH, or an ammonium hydroxide solution may be added to the organic solution and agitated. An amount of addition of an alkaline compound may be determined based on an equivalence ratio to the content of a carboxyl group which is obtained from an acid value of the polyester resin.

Phase inversion emulsification may be performed by adding an excessive amount of water to the polyester resin organic solution to change the organic solution to oil-in-water emulsion. A surfactant may be selectively added.

Polyester resin latex may be obtained by removing the organic solvent from the obtained emulsion using vacuum distillation or the like. As a result, the resin latex (emulsion) including polyester resin particles having an average particle diameter of about 1 μm or less, about 100-300 nm or about 150-250 nm is obtained.

The polyester latex may include another polymer that is obtained by polymerizing one or more types of polymerizable monomers when necessary. The polymerizable monomer may be one or more selected from the group consisting of: a styrenic monomer of styrene, vinyl toluene, α-methyl styrene; acrylic acid, methacrylic acid; derivatives of (meth) acrylic acid of methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, methacrylamide; ethylentically unsaturated mono-olefin of ethylene, propylene, butylenes; halogenated vinyl of vinyl chloride, vinylidene chloride, and vinyl fluoride; vinyl ester of vinyl acetate, vinyl propionate; vinyl ether of methyl vinyl ether, ethyl vinyl ether; vinyl ketone of methyl vinyl ketone, methyl isopropenyl ketone; and a nitrogen-containing vinyl compound of 2-vinylpyridine, 4-vinylpyridine and N-vinylpyrrolidone.

The polyester latex may include a charge control agent. A usable charge control agent includes a negative charging charge control agent and a positive charging charge control agent. The negative charging charge control agent may include: organo-metallic dyes such chrome-containing azo dyes or monoazo metallic dyes, or a chelate compound; a metal-containing salicylic acid compound such as chrome, iron, zinc; and organo-metallic dyes such as aromatic hydroxycarboxylic acid and aromatic dicarboxylic acid, and is not limited if it is well known. The positive charging charge control agent may include a product which is modified by nigrosine and other fatty acid metallic salt, and onium salt including quaternary ammonium salt such as benzyl tributyl ammonium 1-hydroxy-4-naphtho sulfonate and tetrabutyl ammonium tetrafluoroborate. Since the charge control agent stably supports the toner on a developing roller by an electrostatic force, a stable and rapid charging speed can be achieved by using the charge control agent.

A mixed solution may be produced by mixing the polyester resin latex obtained as described above with dispersed liquid of the coloring agent and dispersed liquid of the releasing agent. When the mixed solution is produced, a device such as a homomixer, a homogenizer, or the like may be used.

The dispersed liquid of the coloring agent is obtained by uniformly dispersing the coloring agent such as black, cyan, magenta, yellow, or the like and a composition including an emulsifying agent using an ultrasonic sonifier or a microfludizer. The type and content of the used coloring agent may be as described above. These coloring agents may be used alone or in combination, and may be selected in consideration of color, chroma, brightness, weather resistance, dispersibility of toner, or the like. The emulsifying agent that may be used when the dispersed liquid of the coloring agent is produced may use an emulsifying agent well known in the related art. For example, an anionic reactive emulsifying agent, a nonionic reactive emulsifying agent, or a mixture thereof may be used. Examples of the anionic reactive emulsifying agent include HS-10 (manufactured by Dai-ichi Kogyo) and Dowfax 2A1 (manufactured by Rhodia). Examples of the nonionic reactive emulsifying agent include RN-10 (manufactured by Dai-ichi Kogyo).

The dispersed liquid of the releasing agent includes the releasing agent, water, and an emulsifying agent. The type and content of the used releasing agent may be as described above. The emulsifying agent included in the dispersed liquid of the releasing agent may use an emulsifying agent well known in the related art like the emulsifying agent used in the dispersed liquid of the coloring agent.

Core particles including the polyester binder resin, the coloring agent, and the releasing agent are formed by adding coagulant to the mixed solution. The pH of the mixed solution may be adjusted to be 0.1 to 4.0, the coagulant is added at 25-70° C., for example, and more preferably, at 35-60° C., and the core particles (or a primary aggregation toner) are produced by a shear-induced aggregation mechanism operated by the homogenizer.

As the coagulant, Si and Fe-containing metallic salt may be used. When the Si and Fe-containing metallic salt is used, the size of the primary aggregation toner increases due to an increased iconic strength and collision between particles. The Si and Fe-containing metallic salt may include polysilicate iron, for example, and more specifically, may use product names PSI-025, PSI-050, PSI-085, PSI-100, PSI-200, and PSI-300 (manufactured by Suido Kiko Co.). The Si and Fe-containing metallic salt shows strong cohesiveness even when a small amount of coagulant is used at low temperature, compared with coagulant used in the related-art EA process, and include iron and silica as its main components, so that an effect of remaining aluminum on an environment and a human body, which is a problem of existing trivalent poly aluminum coagulant, can be minimized.

The content of the coagulant may be about 0.1 to 10 parts by weight, about 0.5 to 8 parts by weight, or about 1 to 6 parts by weight for every 100 parts by weight of the polyester resin latex. In this case, when the content of the coagulant is about 0.1 parts by weight or more, aggregation efficiency is enhanced, and, when the content of the coagulant is about 10 parts by weight or less, deterioration of a charge characteristic of the toner can be prevented and particle size distribution can be enhanced.

A shall layer may be formed on the surface of the core particle by adding additional polyester resin latex to the dispersed liquid of the core particles.

Thereafter, when the pH in the system is adjusted to be 6 to 9 and then the particle size is uniformly maintained during a predetermined time, toner particles of about 3-9 μm or about 5-7 μm are produced through a coalescence process at 85 to 100° C.

The toner particles obtained as described above may be separated and dried. When an external additive is added to the dried toner, a final dry type toner can be obtained by adjusting electric charge. The used additive may include silica, titania, alumina, or the like. An amount of addition of the external additive may be about 1.5 to 7 parts by weight or about 2 to 5 parts by weight for every 100 parts by weight of a toner without an external additive. When the amount of addition of the external additive is 1.5 parts by weight or more, a caking phenomenon in which particles are attached to one another due to the cohesiveness between toner particles, thereby forming a cake can be prevented and thus electric charge becomes stable. When the amount of addition of the external additive is 7 parts by weight or less, contamination of a roller can be prevented by the excessive amount of external additive.

The thermal and physical properties of the polyester polymerized toner may be influenced by a morphological structure in the toner, and most of the properties are determined by compatibility between the components.

The compatibility between the polyester binder resin forming the toner and the releasing agent which is wax may directly influence a domain size of each component, dispersity, and viscosity, and accordingly, control forming the morphological structure in the toner particles.

Factors related to the compatibility may include an interfacial tension, a solubility parameter (SP), molecular weight, and weight distribution, and an acid value. For example, when the solubility parameters are similar, the compatibility is enhanced. Therefore, it is possible to design a toner structure using such a relationship. The binder resin and the releasing agent may be combined in an intermediate level between an immiscible level and a partial miscible level. In addition, the occurrence of plasticization may be controlled when the above factors are considered with quantitative analysis of size and number of the releasing agent domains, that is, the was domains on the cross section of the toner, or low molecular weight distribution.

Hereinafter, the present disclosure will be described in more detail with reference to examples and comparison examples. However, the present disclosure is not limited to these examples.

The material properties of the polyester binder resin used in embodiments and comparison examples to be explained below are as shown in table 1 presented below:

TABLE 1

| Binder Resin (Polyester Binder) | | |
|---|---|---|
| Polyester Resin | Solubility Parameter (SP) $(J/cm^3)^{0.5}$ | $Mw_{(Binder)}$[<500 g/mol] (%) |
| R-1 | 11.2 | 2.9 |
| R-2 | 10.5 | 3.3 |
| R-3 | 12.9 | 2.6 |

TABLE 1-continued

| Binder Resin (Polyester Binder) | | |
|---|---|---|
| Polyester Resin | Solubility Parameter (SP) $(J/cm^3)^{0.5}$ | $Mw_{(Binder)}$[<500 g/mol] (%) |
| R-4 | 22.2 | 3.6 |
| R-5 | 22.4 | 3.9 |
| R-6 | 15.3 | 5.5 |
| R-7 | 13.8 | 7.3 |
| R-8 | 14.2 | 6.1 |

($Mw_{(Binder)}$[<500 g/mol] (%) refers to a ratio of a low molecular weight binder resin of molecular weight 500 g/mol or less to the whole binder resin.)

Production Example 1: Production of Polyester Latex L-1

An R-1 resin was dissolved by introducing 400 g of the polyester resin R-1, 600 g of methyl ethyl ketone, and 100 g of isopropyl alcohol (IPA) into a 3 L reactor, and agitating at about 30° C. by a semi-moon type impeller. Emulsified liquid was produced by slowly adding 30 g of an ammonia 5 wt % aqueous solution while agitating the obtained R-1 resin solution and then adding 1500 g of water at speed of 20 g/min while continuing agitating. Latex L-1 having a solid concentration of 20 wt % was produced by removing a solvent from the produced emulsified liquid in a vacuum distillation method.

Production Examples 2 to 8: Production of Polyester Latexes L-2 to L-8

Latexes L-2 to L-8 were obtained in the same way as in production example 1 except for that any one of the polyester resins R-2 to R-8 was used instead of the polyester resin R-1 and an additive of an ammonia 5% aqueous solution was changed little by little to have pH 7-8.

Production Example 9: Production of Dispersed Liquid of Coloring Agent

Dispersed liquid of the coloring agent was produced by getting total 10 g of an anionic reactive emulsifying agent (HS-10; DAI-ICHI KOGYO) and a nonionic reactive emulsifying agent (RN-10; DAI-ICHI KOGYO) at a ratio shown in table 2 presented below, putting the same into a milling bath with 60 g of a cyan pigment (PB 15:4), introducing 400 g of glass beads having a diameter of 0.8-1 mm, and milling at room temperature. In this case, an ultrasonic sonifier or a microfluidzer may be used.

TABLE 2

| Color | Pigment | HS-10:RN-10 (mixing weight ratio) |
|---|---|---|
| Cyan | PB 15:4 | 100:0 |
| | | 80:20 |
| | | 70:30 |

Dispersed Liquid of Releasing Agent

As the releasing agent, wax dispersed liquid SELOSOL P-212 (80-90 wt % of paraffin wax, 10-20 wt % of synthetic ester wax; $T_m$ 72° C.; viscosity 13 mPa·s at 25° C.) provided by CHUKYO YUSHI CO., LTD. was used. The solubility parameter of the used wax was 18.48 $(J/cm^3)^{0.5}$.

Example 1: Production of Toner 764 g of deionized water and 812 g of latex L-1 were put into a 3 L reactor, and were agitated at 350 rpm. 77 g of the dispersed liquid of the cyan pigment (HS-10 100%) in production example 9, and 80 g of wax dispersed liquid P-212 (CHUKYO YUSHI CO., LTD.) were put into the reactor, and then 50 g of nitric acid (0.3 mols) having concentration of 0.3N and 25 g of PSI-100 (Suido kiko Co.) as a coagulant were further put, and were agitated using a homogenizer and were heated to 50° C. at speed of 1° C./minute. Thereafter, when agglutination continued by increasing temperature at speed of 0.03° C./minute and was achieved to have a size of 4-5 μm, 300 g of latex L-1 was additionally added to form a shell layer, and was flocculated for 0.5 hour, and then an aqueous solution of 1N NaOH was added and pH was adjusted to be 7.5 to 10, and the temperature was increased to 85 to 90° C. after 20 minutes later and fusing was performed for 3-5 hours. When the agglutination was achieved to have a size of 5-7 μm, this agglutination liquid was cooled under glass transition temperature and then toner particles were separated and dried through a filtering process. An external additive was added to the toner particles by adding 0.5 parts by weight of NX-90 (Nippon Aerosil), 1.0 parts by weight of RX-200 (Nippon Aerosil), and 0.5 parts by weight of SW-100 (Titan Kogyo) to 100 parts by weight of the dried toner particles in a mixer (KM-LS2K, Daewha Tech.), and agitating for 4 minutes at 6,000 rpm.

Examples 2 and 3 and Comparison Examples 1 to 5: Production of Toner

Toners in examples 2 and 3 and comparison examples 1 to 5 were produced in the same method as in example 1 except for that the latex was changed as shown in table 3 presented below:

TABLE 3

| | Polyester Latex | $\lvert SP_{(Binder)} - SP_{(Wax)} \rvert$ |
|---|---|---|
| Example 1 | L-1 | 7.3 |
| Example 2 | L-2 | 8.0 |
| Example 3 | L-3 | 5.6 |
| Comparison Example 1 | L-4 | 3.7 |
| Comparison Example 2 | L-5 | 3.5 |
| Comparison Example 3 | L-6 | 3.2 |
| Comparison Example 4 | L-7 | 3.9 |
| Comparison Example 5 | L-8 | 4.2 |

($\lvert SP_{(Binder)} - SP_{(Wax)} \rvert$ refers to a difference in the solubility parameter between a polyester resin which is a binder resin and wax which is a releasing agent.)

<Evaluating Method of Toner>

Evaluation of Fixing Property

A test image was fixed in the following conditions using an X7600 NIF fixing device (manufactured by Samsung Electronics Co., Ltd. and having a model name of color laser MX7):

Non-fixed image for a test: 100% pattern

Test temperature: 120-200° C. (intervals of 10° C.)

Fixing speed: 285 mm/sec

Fixing time: 0.08 sec

After experiments were conducted in the above-described conditions, the fixing property of the fixed image was evaluated as follows:

The OD of the fixed image was measured and then a tape of 3M 801 was attached to a portion of the image, and the image was reciprocated five times using a weight of 500 g and then the tape was removed. The OD was measured after the tape was removed.

Fixing property (%): (OD_after peeling the tape/OD_before peeling the tape)×100

A fixing temperature area having a fixing property greater than or equal to 90% was regarded as a fixing area of a toner.

MFT: Minimum Fusing Temperature (minimum temperature resulting in the fixing property greater than or equal to 90% without cold-offset)

HOT: HOT Offset Temperature (minimum temperature resulting in occurrence of hot-offset)

COT: COLD Offset Temperature (minimum temperature resulting in occurrence of cold-offset)

Evaluation of Gloss

A gloss (%) was measured at 160° C. which is using temperature of the fixing device using a glossmeter (manufactured by BYK Gardner and having a product name of micro-TRI-gloss) which is a gloss measurement device.

Measurement angle: 60°

Measurement pattern: 100% pattern

Evaluation of Heat Storage Ability 100 g of a toner was externally added and then was introduced into a developing device (manufactured by Samsung Electronics Co., LTD. and having a model name of color laser 660), and was stored in a constant temperature and humidity oven in a packing state as follows: 23° C., 55% RH (Relative Humidity) 2 hours⇒40° C., 90% RH 48 hours⇒50° C., 80% RH 48 hours⇒40° C., 90% RH 48 hours⇒23° C., 55% RH 6 hours.

After the toner was stored as described above, the presence/absence of caking of the toner in the developing device was checked with naked eyes, a 100% image was outputted, and a defect in the image was evaluated.

Evaluation Criteria

○: Good image quality, no caking

Δ: Poor image quality, no caking

X: Occurrence of Caking

<Evaluation of Toner's anti-cohesiveness (Carr's Cohesion)>

Equipment: Hosokawa micron powder tester PT-S

Amount of pigment: 2 g (toner with or without an external additive)

Amplitude: 1 mm_dial 3~3.5

Sieve: 53, 45, 38 μm

Vibration time: 120 seconds

The toner was stored at 23° C. and 55% relative humidity (RH) for 2 hours, and then the cohesion of the toner was calculated by measuring a change of amount before and after sieving in the sieve of each size in the above-described conditions:

[(mass of powder remaining on the largest sieve)/2 g]×100 (1)

[(mass of powder remaining on the sieve of a middle size)/2 g]×100×(3/5) (2)

[(mass of powder remaining on the smallest sieve)/2 g]×100×(1/5) (3))

Cohesion (Carr's cohesion)=(1)+(2)+(3)

The anti-cohesiveness of the toner was evaluated from the cohesion value according the following criteria:

◎: a state in which cohesion is less than or equal to 10 and flowability is good ○: a state in which cohesion is greater than 10 and less than or equal to 20 and flowability is good Δ: a state in which cohesion is greater than 20 and less than or equal to 40 and flowability becomes a bit bad X: a state in which cohesion is greater than 40 and flowability is bad.

<Evaluation of Average Circularity>

The shape of the produced toner was checked through an SEM photo. The circularity of the toner was calculated based on equation (4) using FPIA-3000 equipment of SYSMEX:

$$\text{Circularity}=2\times(\pi\times\text{area})^{0.5}/\text{perimeter} \quad (4)$$

The circularity has values ranging from 0 to 1. As the circularity value is closer to 1, the toner particle is closer to a spherical shape. The average circularity was calculated by calculating an average of circularity values of 3,000 toner particles.

was cut using a ultramicrotome (manufactured by RMC and having a product name of Power TOME XL), and the cross section of the toner particle was observed using field emission scanning electron microscopy (FE-SEM) (produced by HITACHI and having a product name of S-4500, and measured in the conditions: vacuum pressure of $10^{-4}$ Pa or more, acceleration voltage 5-15 kV).

Figure 2:
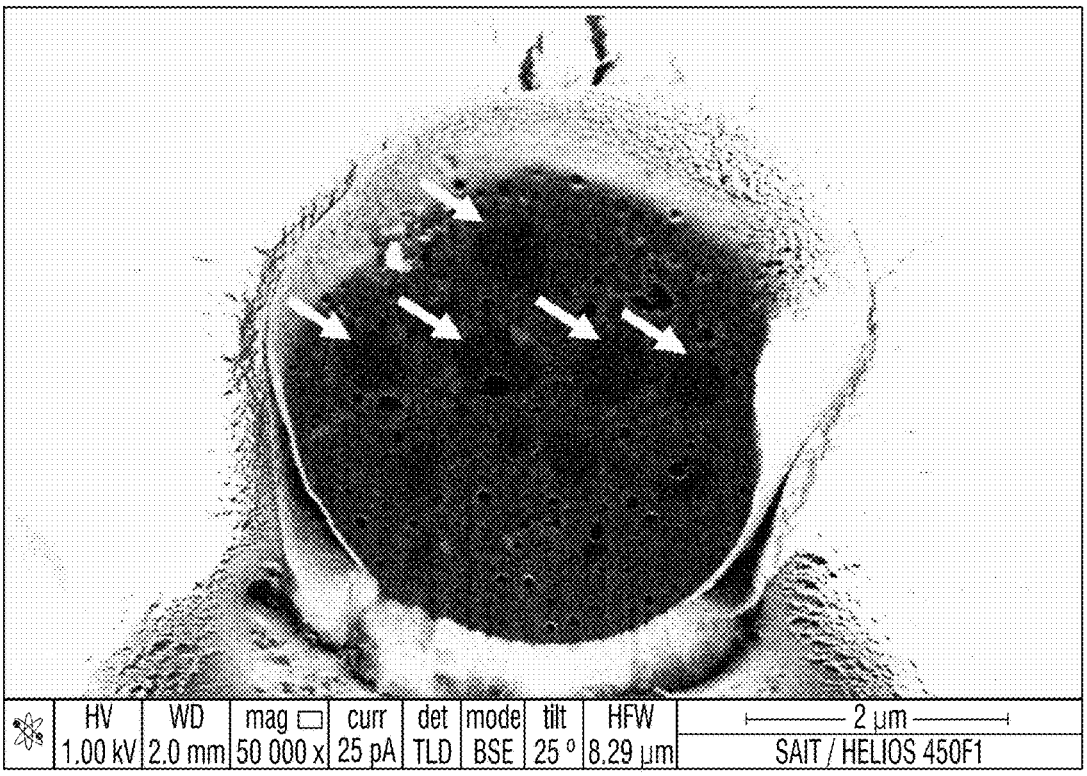
FIG. 2 is a view showing a cross sectional SEM image according to a related-art method.

FIG. 1 is a view showing a cross sectional image of a toner which is produced satisfying the conditions of the present disclosure, and FIG. 2 is a view showing a cross sectional image of a related-art toner which does not satisfy the conditions of the present disclosure. Comparing FIG. 1 and FIG. 2, it can be seen that the number of releasing agent domains (indicated by arrows) in FIG. 1 is larger than that of FIG. 2, and the size of the domain is reduced.

The results of evaluating the toners in examples 1-3 and comparison examples 1-5 are summarized in table 4 presented below:

TABLE 4

| Toner Characteristics | | | | | | | |
|---|---|---|---|---|---|---|---|
| | | | Fusing Latitude | | | Storage | Anti- |
| | $W_{(L)}/T_{(L)}$ | $N_{(stain)}$ | COT | HOT | Gloss | Stability | cohesiveness |
| Example 1 | 0.09 | 22 | 140° C. | 190° C. | 13.8 | ○ | ◎ |
| Example 2 | 0.06 | 29 | 140° C. | 195° C. | 12.8 | ○ | ◎ |
| Example 3 | 0.10 | 16 | 135° C. | 185° C. | 12.1 | ○ | ◎ |
| Comparison Example 1 | 0.29 | 11 | 140° C. | 165° C. | 12.3 | Δ | ○ |
| Comparison Example 2 | 0.28 | 11 | 140° C. | 160° C. | 10.2 | ○ | ○ |
| Comparison Example 3 | 0.26 | 13 | 145° C. | 160° C. | 10.5 | Δ | Δ |
| Comparison Example 4 | 0.32 | 9 | 145° C. | 160° C. | 11.4 | X | X |
| Comparison Example 5 | 0.33 | 8 | 140° C. | 160° C. | 10.2 | X | Δ |

<Evaluation of Particle Size Distribution>

A volume average particle size distribution index (GSDv) and a number average particle size distribution index (GSDp) which are indexes of particle size distribution of the toner particles were measured in the following conditions using a multisizer III (Beckman Coulter) measurement device, which is a coulter counter:

Electrolyte: ISOTON II

Aperture Tube: 100 μm

Number of measured particles: 30,000

From the measured particle size distribution of the toner, a cumulative distribution for volume and number of individual toner particles was plotted as a divided particle size range (i.e., channel) in order of increasing diameter. A particle diameter at cumulative 16% is defined as volume average particle size D16v and number average particle size D16p, and a diameter at cumulative 50% is defined as volume average particle size D50v and number average particle size D50p. Similarly, a particle diameter at cumulative 84% is defined as volume average particle size D84v and number average particle size D84p. GSDv and GSDp are calculated by using equations (5) and (6):

$$GSDv=(D84v/D16v)^{0.5} \quad (5)$$

$$GSDp=(D84d/D16p)^{0.5} \quad (6)$$

<Analysis of Cross Section of Toner>

The toner particles were stained with ruthenium tetroxide and then were molded using an epoxy resin, and the toner ($N_{stain}$ refers to the number of wax domains which are stained releasing agents when the particles of the toner are stained with ruthenium tetraoxide ($RuO_4$) and the cross section of the particle of the toner is observed. $W_{(L)}$ refers to the longest length of the lengths of the stained wax domains, and $T_{(L)}$ refers to the longest length of the toner particle cross section.)

As shown in Table 4, in examples 1 to 3, the ratio of the longest length ($W_{(L)}$) of the wax domains on the cross sectional image of the toner particle to the longest length ($T_{(L)}$) of the toner cross section, and the number of stained wax domains ($N_{stain}$) satisfy the above-described conditions, and thus various characteristics such as a wide fusing latitude (50° C.), a high gloss, and heat storage stability are simultaneously satisfied and there is no problem. However, as shown in comparison examples 1 to 5, when the ratio ($W_{(L)}/T_{(L)}$) and a difference in SPs between the binder resin and the releasing agent do not satisfy the above-described conditions, the dispersity of the releasing agent domain deteriorates and the compatibility between the releasing agent and the binder resin occurs, and thus efficiency of releasing the releasing agent from the toner surface deteriorates and the peeling force from a fixing roller deteriorates. In addition, temperature at which hot-offset occurs decreases and thus the fusing latitude becomes narrow. In the cases of comparison examples 4 and 5, even when the difference in the SP values is relatively great since the dispersity of the releasing agent domain greatly deteriorates and the low Mw ratio increases, plasticization occurs due to the compatibility and thus anti-cohesiveness and heat storage ability deteriorate.

According to another aspect of the present disclosure, a consumable unit of an image forming apparatus including the above-described toner, that is, a toner cartridge, may be provided.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A toner for developing an electrostatic image, the toner comprising:

a particle of the toner including:

a releasing agent having a solubility parameter ($SP_{(Wax)}$) [$(J/cm^3)^{0.5}$];

a binder resin having a solubility parameter ($SP_{(Binder)}$) [$(J/cm^3)^{0.5}$], to satisfy $$|SP_{(Binder)}-SP_{(Wax)}|>5; \text{ and}$$

a coloring agent, wherein the releasing agent is arranged in the particle of the toner to satisfy conditions of:

$$(W_{(L)}/T_{(L)})\leq 0.1, \text{ and}$$

$$15<N_{stain},$$

where, $N_{stain}$ refers to a number of stained releasing agent domains when the particle of the toner is stained with ruthenium tetraoxide ($RuO_4$) and a cross section of the particle of the toner is observed, $W_{(L)}$ refers to a longest length of lengths of the stained releasing agent domains, and $T_{(L)}$ refers to a longest length of the cross section of the particle of the toner.

2. The toner of claim 1, wherein the binder resin comprises a low molecular weight binder resin having a weight-average molecular weight less than 500 g/mol to be less than or equal to 3.5 weight percent (wt %) based on a whole weight of the binder resin.

3. The toner of claim 1, wherein an average of circularity of the toner is 0.940 to 0.980.

4. The toner of claim 1, wherein an average particle size of the toner is 3 to 9.5 μm.

5. The toner of claim 1, wherein a volume average particle size distribution index (GSDv) of the toner is less than or equal to 1.25 and a number average particle size distribution index (GSDp) of the toner is less than or equal to 1.30.

6. The toner of claim 1, wherein, from among particles of the toner, at least one fine particle having a particle size less than or equal to 3 μm is less than 3 weight percent (wt %) based on a weight of the particles of the toner, and at least one coarse particle having a particle size greater than or equal to 16 μm is less than 0.5 weight percent (wt %) based on a weight of the particles of the toner.

7. A consumable of an image forming apparatus, the consumable comprising:

a toner for developing an electrostatic image, a particle the toner including:

a releasing agent having a solubility parameter ($SP_{(Wax)}$) [$(J/cm^3)^{0.5}$];

a binder resin having a solubility parameter ($SP_{(Binder)}$) [$(J/cm^3)^{0.5}$], to satisfy $$|SP_{(Binder)}-SP_{(Wax)}|>5, \text{ and}$$

a coloring agent, wherein the releasing agent is arranged in the particle of the toner to satisfy conditions of:

$$(W_{(L)}/T_{(L)})\leq 0.1, \text{ and}$$

$$15<N_{stain},$$

where, $N_{stain}$ refers to a number of stained releasing agent domains when the particle of the toner is stained with ruthenium tetraoxide ($RuO_4$) and a cross section of the particle of the toner is observed, $W_{(L)}$ refers to a longest length of lengths of the stained releasing agent domains, and $T_{(L)}$ refers to a longest length of the cross section of the particle of the toner.

* * * * *